US010104988B2

(12) United States Patent
Knudsen

(10) Patent No.: US 10,104,988 B2
(45) Date of Patent: Oct. 23, 2018

(54) FENCE PANEL DISPLAY SYSTEMS AND METHODS

(71) Applicant: N. Eric Knudsen, Maple Valley, WA (US)

(72) Inventor: N. Eric Knudsen, Maple Valley, WA (US)

( * ) Notice: Subject to any disclaimer, the term of this patent is extended or adjusted under 35 U.S.C. 154(b) by 190 days.

(21) Appl. No.: 14/667,398

(22) Filed: Mar. 24, 2015

(65) Prior Publication Data

US 2016/0045041 A1 Feb. 18, 2016

Related U.S. Application Data

(60) Provisional application No. 62/037,547, filed on Aug. 14, 2014.

(51) Int. Cl.

| | |
|---|---|
| ***A47F 5/00*** | (2006.01) |
| ***A47F 7/14*** | (2006.01) |
| ***A47F 7/00*** | (2006.01) |

(52) U.S. Cl.

CPC ..... *A47F 7/0042* (2013.01); *A47F 5/005* (2013.01); *A47F 5/0062* (2013.01); *A47F 7/145* (2013.01)

(58) Field of Classification Search

CPC ..... A47F 7/145; A47F 7/0042; A47F 5/0018; A47F 5/0807; A47F 5/10; A47F 7/14; A47F 7/144; A47F 7/00; A47F 5/00; A47F 5/005; A47F 5/0062

See application file for complete search history.

(56) References Cited

U.S. PATENT DOCUMENTS

| | | | | | |
|---|---|---|---|---|---|
| 1,594,754 | A * | 8/1926 | Reines | A47F 7/145 | 108/61 |
| 1,739,730 | A * | 12/1929 | Orthwine | A47F 5/0062 | 206/459.5 |
| 1,884,540 | A * | 10/1932 | Block | G09F 1/10 | 211/184 |
| 1,895,283 | A * | 1/1933 | Friedemann | A47F 5/10 | 108/96 |
| 2,192,243 | A * | 3/1940 | Rogers | A47F 7/144 | 211/55 |
| 2,333,717 | A * | 11/1943 | Heed | A47F 5/0037 | 211/50 |
| 2,532,600 | A * | 12/1950 | Broersma | A47F 7/145 | 211/128.1 |
| 2,869,732 | A * | 1/1959 | Ganz | A47F 5/005 | 211/55 |
| 2,938,634 | A * | 5/1960 | Ganz | A47F 7/145 | 211/55 |

(Continued)

OTHER PUBLICATIONS

Photos of a product display at a home improvement store taken Aug. 13, 2014, 2 pages.

*Primary Examiner* — Kimberley S Wright

(74) *Attorney, Agent, or Firm* — Seed IP Law Group LLP

(57) ABSTRACT

Fence panel display systems can include a unitary foundation including a plurality of steps, at least one rail extending along the width of one of the steps, and at least two clamp assemblies adjustably coupled to the rail. A fence panel can be clamped to the foundation using the clamp assemblies by adjusting the clamp assemblies along the width of the step and by adjusting protrusions extending from main bodies of the clamp assemblies in a direction perpendicular to the width of the step.

11 Claims, 6 Drawing Sheets

(56) References Cited

U.S. PATENT DOCUMENTS 2,951,001 A * 8/1960 Rubenstein ..... B44C 5/04 156/245
3,285,424 A * 11/1966 Emery ..... A47F 7/145 108/60
3,298,538 A * 1/1967 Ganz ..... A47F 7/145 211/184
3,612,292 A * 10/1971 Nervig ..... 211/174
3,892,450 A * 7/1975 Kolster ..... A47F 7/144 211/55
4,121,717 A * 10/1978 Hensel, Jr. ..... A47F 7/163 16/94 R
4,460,097 A * 7/1984 Darnell, II ..... A47F 7/145 108/108
4,796,764 A * 1/1989 Hardy ..... G09F 1/10 211/184
5,485,928 A * 1/1996 Felton ..... A47F 7/145 211/128.1
5,720,396 A * 2/1998 Wegscheid ..... A47F 7/145 211/55
6,116,433 A * 9/2000 Pursall ..... A47F 7/145 211/55
6,412,648 B1 * 7/2002 Woolnough ..... A47F 7/145 211/128.1
7,775,379 B2 * 8/2010 Hodge ..... A47F 5/0846 100/108
7,913,862 B2 * 3/2011 Collins ..... A47F 5/005 211/184
8,292,195 B2 * 10/2012 Freeman ..... B05B 17/085 239/17
2008/0078728 A1 * 4/2008 Hodge ..... A47F 7/144 211/55
2010/0327076 A1 * 12/2010 Freeman ..... B05B 17/085 239/20
2012/0248050 A1 * 10/2012 Heintz ..... A47F 3/142 211/59.2
2013/0008116 A1 * 1/2013 Turner, III ..... E04C 2/34 52/474
2015/0298885 A1 * 10/2015 Giller ..... B65D 81/055 206/597
2016/0035255 A1 * 2/2016 Marler ..... G09F 3/204 211/186

* cited by examiner

FENCE PANEL DISPLAY SYSTEMS AND METHODS

BACKGROUND

Technical Field

The present disclosure relates to systems for displaying fence panels of different dimensions as well as methods of making and using such systems.

Description of the Related Art

Fences can be made from a variety of materials and in a variety of styles, and can be sold in panels, which can simplify the shipping and installation of a fence. Thus, retailers can display multiple fence panels for their customers' consideration prior to purchase. Due in part to their size, however, displaying multiple fence panels can be floor-space intensive. There is much room for improvement in systems and methods of displaying fence panels for consideration by consumers.

BRIEF SUMMARY

In some embodiments, a product display system comprises a foundation having a plurality of steps formed of a unitary body of material, each step having a step width, a rail coupled to one of the plurality of steps and extending along a direction of the step width, a first clamp element coupled to the rail and adjustable on the rail along the direction of the step width, and a second clamp element coupled to the rail and adjustable on the rail along the direction of the step width.

In some cases, the first clamp element includes a first main body extending horizontally outward from the rail and a first protrusion extending outward from the first main body toward the second clamp element, and the second clamp element includes a second main body extending horizontally outward from the rail and a second protrusion extending outward from the second main body toward the first clamp element. In some cases, the first clamp element and the second clamp element are configured to slide along the rail to clamp a fence panel between the first clamp element and the second clamp element In some cases, the system further comprises a fence panel clamped between the first clamp element and the second clamp element. In some cases, the foundation includes at least a first step and a second step above the first step and the fence panel is supported on the second step. In some cases, the foundation further comprises a pair of recesses sized and shaped to receive tines of a forklift. In some cases, each step includes a riser portion and a tread portion, and the rail is coupled to the riser portion and to the tread portion of the step to which the rail is coupled.

In some cases, the system further comprises a second rail coupled to another one of the plurality of steps and extending along the direction of the step width, a third clamp element coupled to the second rail and adjustable on the second rail along the direction of the step width, and a fourth clamp element coupled to the second rail and adjustable on the second rail along the direction of the step width. In some cases, the foundation is formed of a unitary body of concrete. In some cases, the foundation has a cavity underneath each of the plurality of steps. In some cases, the unitary body of material is made of glass-fiber reinforced concrete.

In other embodiments, a method comprises forming a foundation having a plurality of steps of a unitary body of material, each step having a step width, coupling a rail to one of the plurality of steps such that the rail extends along a direction of the step width, coupling a first clamp element to the rail such that the first clamp element is adjustable on the rail along the direction of the step width, and coupling a second clamp element to the rail such that the second clamp element is adjustable on the rail along the direction of the step width.

In some cases, the method further comprises clamping a fence panel between the first clamp element and the second clamp element. In some cases, the fence panel is supported on another one of the plurality of steps. In some cases, clamping a fence panel between the first clamp element and the second clamp element comprises positioning the fence panel on the another one of the plurality of steps, sliding the first clamp element toward the fence panel, and sliding the second clamp element toward the fence panel. In some cases, forming the foundation comprises casting a glass-fiber reinforced concrete foundation. In some cases, forming the foundation comprises coating an exposed face of a mold cavity with a GFRC mix, and casting a self-consolidating concrete mix in the mold cavity. The method may further include, prior to casting the self-consolidating concrete mix, providing internal reinforcement members, such as steel studs, in the mold cavity.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with the technology have not been shown or described in detail to avoid unnecessarily obscuring descriptions of the embodiments.

Figure 1:
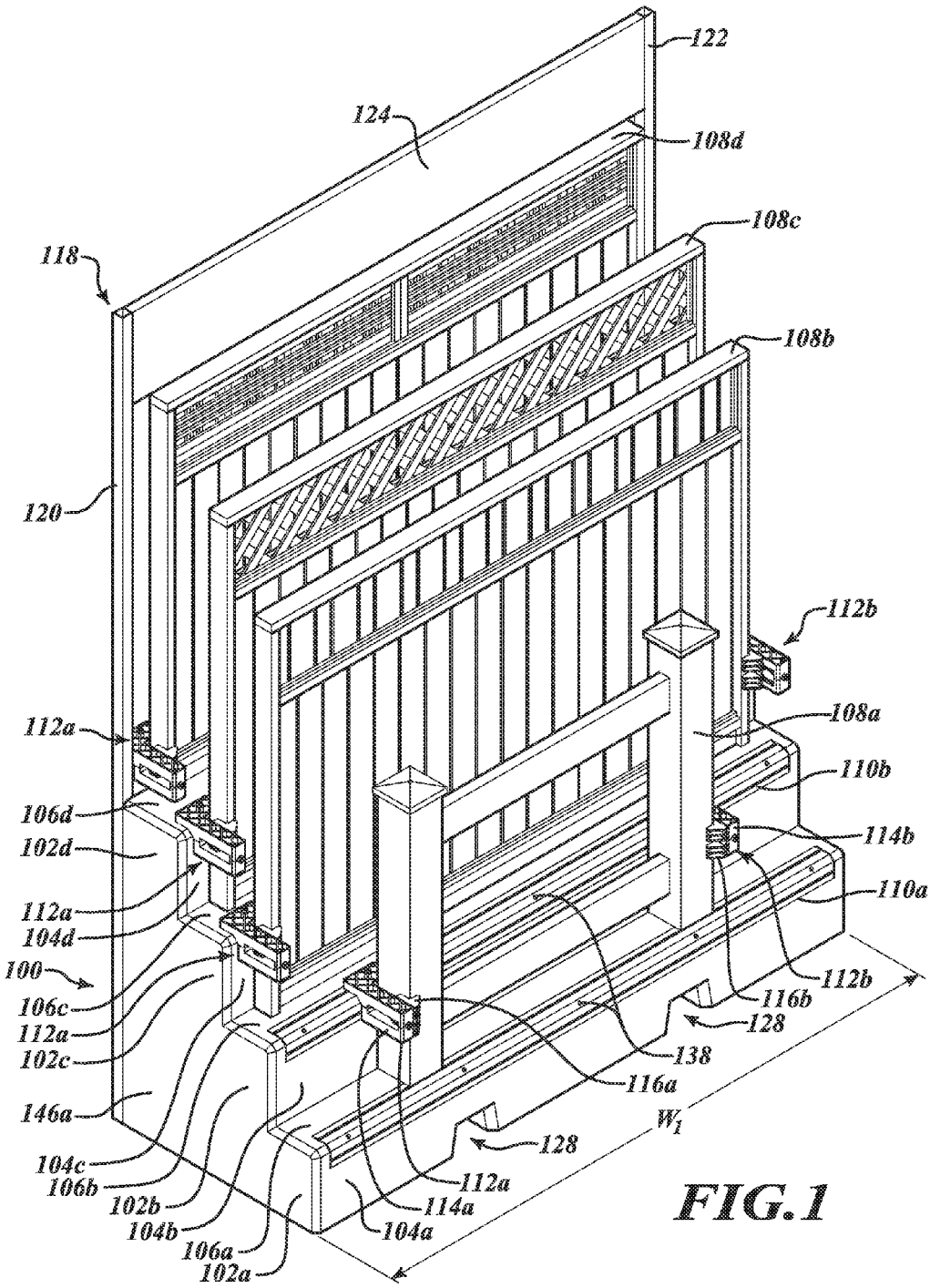
FIG. 1 illustrates a front isometric view of one embodiment of a fence panel display system.

FIG. 1 illustrates one embodiment of a fence panel display system 100. Display system 100 can include a set of steps 102*a*, 102*b*, 102*c*, and 102*d* (collectively, steps 102), extending upwards and rearwards from a first, bottommost one of the plurality of steps 102*a* to a second step 102*b*, to a third step 102*c*, to a fourth, topmost one of the plurality of steps 102*d*. The display system 100 shown in FIG. 1 includes four steps 102, but in alternative embodiments, display systems can include additional or fewer steps 102. Each of the steps 102 can include a respective step riser portion 104 (e.g., riser portions 104*a*, 104*b*, 104*c*, 104*d*), a step tread portion 106 (e.g., tread portions 106*a*, 106*b*, 106*c*, 106*d*), and a step width $W_1$. In the embodiment illustrated in FIG. 1, each of the steps 102 has the same width $W_1$, although in alternative embodiments, the steps 102 can have different widths. The steps 102 may be formed of concrete or other materials that may be cast or otherwise formed as a unitary body of material. In other embodiments, the steps 102 may also be formed of a different material or materials, such as, for example, steel or other metallic components, such as welded steel tubes. For instance, the steps may be formed as a weldment or assembly of steel components. The display system 100 can be used to display a plurality of fence panels 108*a*, 108*b*, 108*c*, 108*d* (collectively, fence panels 108). The display system 100 can also be used to display gates, doors, other similar devices, or any combination thereof. The display system 100 is shown displaying four fence panels 108, but in alternative embodiments, display systems can be used to display additional or fewer fence panels 108. In the embodiment illustrated in FIG. 1, each of the steps 102 has a width $W_1$ sufficient to hold a single fence panel, although in alternative embodiments, the steps 102 can have widths sufficient to hold multiple fence panels 108 on each step 102. The display system 100 can include a plurality of rails 110 (e.g., rails 110*a* and 110*b*) coupled to the steps 102. For example, as shown in FIG. 1, the display system 100 can include one rail 110 coupled to each of the steps 102. As shown in FIG. 1, a rail 110 can be coupled to both the riser portion 104 and a tread portion 106 of a single step 102.

The display system 100 can also include one or more clamp assemblies 112 coupled to each of the rails 110. For example, the display system 100 can include what can be referred to as a "left clamp assembly" 112*a* and a "right clamp assembly" 112*b* (collectively, clamp assemblies 112) coupled to each rail 110. A left clamp assembly 112*a* can have the same structure as, but be a mirror image of, a right clamp assembly 112*b*. A left clamp assembly 112*a* and a right clamp assembly 112*b* can be coupled to a single rail 110 such that the left clamp assembly 112*a* is on a left side of the right clamp assembly 112*b*, as viewed from the front of the display system 100 and as viewed in FIG. 1. A left clamp assembly 112*a* and a right clamp assembly 112*b* coupled to a single rail 110 can be referred to as a pair of clamp assemblies 112. Each of the clamp assemblies 112 can be adjustably mounted to one of the rails 110, such that the clamp assemblies 112 can slide along the rails 110 in the direction of the step width $W_1$.

Each left clamp assembly 112*a* can include a main body 114*a* extending horizontally outward from the rail 110 to which the left clamp assembly 112*a* is coupled, such as in a direction perpendicular to the width $W_1$ of the display system 100. Each right clamp assembly 112*b* can include a main body 114*b* extending horizontally outward from the rail 110 to which the right clamp assembly 112*b* is coupled, such as in a direction perpendicular to the width $W_1$ of the display system 100. Each left clamp assembly 112*a* of a pair of clamp assemblies 112 can include a tooth or protrusion 116*a* extending outwardly from the main body 114*a* of the left clamp assembly 112*a* in the direction of the width $W_1$ of the display system 100 toward the right clamp assembly 112*b* of the pair of clamp assemblies 112. Likewise, each right clamp assembly 112*b* of a pair of clamp assemblies 112 can include a tooth or protrusion 116*b* extending outwardly from the main body 114*b* of the right clamp assembly 112*b* in the direction of the width $W_1$ of the display system 100 toward the left clamp assembly 112*a* of the pair of clamp assemblies 112.

The protrusion 116*a* of each left clamp assembly 112*a* can be adjustably mounted to its respective main body 114*a*, such that the protrusion 116*a* can be adjusted to move along a length of the respective main body 114*a* horizontally toward or away from the rail 110 to which the left clamp assembly 112*a* is coupled. Similarly, the protrusion 116*b* of each right clamp assembly 112*b* can be adjustably mounted to its respective main body 114*b*, such that the protrusion 116*b* can be adjusted to move along a length of the respective main body 114*b* horizontally toward or away from the rail 110 to which the right clamp assembly 112*b* is coupled.

The display system 100 can be used to secure and display fence panels 108 of a variety of lengths and thicknesses. For example, the fence panel 108*a* has a shorter length (e.g., as measured in the direction of the width $W_1$ of the display system 100) than the fence panel 108*b*, but has a greater thickness (e.g., as measured in a horizontal direction perpendicular to its length) than the fence panel 108*b*. To secure a fence panel 108 of a given length, a pair of clamp assemblies 112 can be adjusted to move along a rail 110 until they are separated from one another by the given length of the fence panel 108. To secure a fence panel 108 of a given thickness, the protrusions 116*a*, 116*b* of a pair of clamp assemblies 112 can be adjusted to move along the main bodies 114*a*, 114*b* of the pair of clamp assemblies 112 until they are separated from the riser portion 104 of an adjacent step 102 by the given thickness of the fence panel 108.

Fence panel 108*a* can be secured to the display system 100 by first positioning the fence panel 108*a* on the tread portion 106*a* of the first, bottommost step 102*a*. In some cases, the fence panel 108*a* can be centered on the first step 102*a*. The pair of clamp assemblies 112 coupled to the rail 110*b* coupled to the second step 102*b* can then be adjusted so as to abut the fence panel 108*a*, thereby clamping it or restraining it against motion in the direction of the width $W_1$ of the display system 100. For example, the left clamp assembly 112*a* coupled to the second step 102*b* can abut a first, left end (as viewed in FIG. 1) of the fence panel 108*a* and the right clamp assembly 112*b* coupled to the second step 102*b* can abut a second, right end (as viewed in FIG. 1) of the fence panel 108*a*. The pair of protrusions 116*a*, 116*b* of the pair of clamp assemblies 112 coupled to the rail 110*b* can then be adjusted so as to abut a front of the fence panel 108*a*, thereby further clamping it or restraining it against motion away from the riser portion 104*b* of the second step 102*b*.

In some cases, an additional retention element (not illustrated) can be coupled to the tread portion 106*a* of the first step 102*a*, such as to the rail 110*a*. The additional retention element can engage a bottom-most portion of the fence panel 108*a* so as to prevent outward movement of the bottom-most portion of the fence panel 108*a* and thereby prevent the fence panel 108*a* from tilting backwards on the display system 100. Fence panel 108*b* can be secured to the display system 100 by first positioning the fence panel 108*b* on the tread portion 106*b* of the second step 102*b*. In some cases, the fence panel 108*b* can be centered on the second step 102*b*. The pair of clamp assemblies 112 coupled to the rail (not visible in FIG. 1) coupled to the third step 102*c* can then be adjusted so as to abut the fence panel 108*b*, thereby clamping it or restraining it against motion in the direction of the width $W_1$ of the display system 100. For example, the left clamp assembly 112*a* coupled to the third step 102*c* can abut a first, left end (as viewed in FIG. 1) of the fence panel

108*b* and the right clamp assembly 112*b* coupled to the third step 102*c* can abut a second, right end (as viewed in FIG. 1) of the fence panel 108*b*. The pair of protrusions 116*a*, 116*b* of the pair of clamp assemblies 112 coupled to the third step 102*c* can then be adjusted so as to abut a front of the fence panel 108*b*, thereby further clamping it or restraining it against motion away from the riser portion 104*c* of the third step 102*c*.

In some cases, an additional retention element (not illustrated) can be coupled to the tread portion 106*b* of the second step 102*b*, such as to the rail 110*b*. The additional retention element can engage a bottom-most portion of the fence panel 108*b* so as to prevent outward movement of the bottom-most portion of the fence panel 108*b* and thereby prevent the fence panel 108*b* from tilting backwards on the display system 100. In some cases, the additional retention element can be integrated into one or both of the clamp assemblies 112 coupled to the rail 110*b*.

Fence panel 108*c* can be secured to the display system 100 by first positioning the fence panel 108*c* on the tread portion 106*c* of the third step 102*c*. In some cases, the fence panel 108*c* can be centered on the third step 102*c*. The pair of clamp assemblies 112 coupled to the rail (not visible in FIG. 1) coupled to the fourth step 102*d* can then be adjusted so as to abut the fence panel 108*c*, thereby clamping it or restraining it against motion in the direction of the width $W_1$ of the display system 100. For example, the left clamp assembly 112*a* coupled to the fourth step 102*d* can abut a first, left end (as viewed in FIG. 1) of the fence panel 108*c* and the right clamp assembly 112*b* coupled to the fourth step 102*d* can abut a second, right end (as viewed in FIG. 1) of the fence panel 108*c*. The pair of protrusions 116*a*, 116*b* of the pair of clamp assemblies 112 coupled to the fourth step 102*d* can then be adjusted so as to abut a front of the fence panel 108*c*, thereby further clamping it or restraining it against motion away from the riser portion 104*d* of the fourth step 102*d*. In some cases, an additional retention element (not illustrated) can be coupled to the tread portion 106*c* of the third step 102*c*, such as to the rail coupled to the third step 102*c*. The additional retention element can engage a bottom-most portion of the fence panel 108*c* so as to prevent outward movement of the bottom-most portion of the fence panel 108*c* and thereby prevent the fence panel 108*c* from tilting backwards on the display system 100. In some cases, the additional retention element can be integrated into one or both of the clamp assemblies 112 coupled to the rail 110*c*.

A rear panel 118 can be secured to the rear of the display system 100. The rear panel 118 can include a first, left post 120, a second, right post 122, and a top beam 124 extending from a top end portion of the first post 120 to a top end portion of the second post 122 in the direction of the width $W_1$ of the display system 100. The first post 120 can be coupled to a rear surface of a first, left sidewall 146*a* of the steps 102, such as by adhesive, mechanical fastener, etc. The second post 122 can be coupled to a rear surface of a second, right sidewall 146*b* (see FIG. 4) of the steps 102, such as by adhesive, mechanical fastener, etc. The top beam 124 can include advertisements, promotional or educational information, or other matter printed thereon. In some embodiments, the first and second posts 120, 122 can be hinged to allow the top beam 124 to be lowered forward or backward to allow changes to the advertisements, promotion or educational information, or other matter printed thereon to be made more easily.

The rear panel 118 can also include a bottom beam 126 (see FIG. 4) spanning from a middle portion of the first post 120 to a middle portion of the second post 122 in the direction of the width $W_1$ of the display system 100. The bottom beam 126 can be positioned a small distance above the tread portion 106*d* of the fourth step 102*d*. As one example, the small distance can be about equal to or approximate a height of one of the riser portions 104. A pair of clamp assemblies 112 can be coupled to the bottom beam 126 in a manner similar to that described above with respect to a pair of clamp assemblies 112 being coupled to a rail 110. For example, the bottom beam 126 may include a rail coupled thereto or formed therein along which a pair of clamp assemblies 112 may adjustably slide back and forth.

Fence panel 108*d* can be secured to the display system 100 by first positioning the fence panel 108*d* on the tread portion 106*d* of the fourth step 102*d*. In some cases, the fence panel 108*d* can be centered on the fourth step 102*d*. The pair of clamp assemblies 112 coupled to the bottom beam 126 can then be adjusted so as to abut the fence panel 108*d*, thereby clamping it or restraining it against motion in the direction of the width $W_1$ of the display system 100. For example, the left clamp assembly 112*a* coupled to the bottom beam 126 can abut a first, left end (as viewed in FIG. 1) of the fence panel 108*d* and the right clamp assembly 112*b* coupled to the bottom beam 126 can abut a second, right end (as viewed in FIG. 1) of the fence panel 108*d*. The pair of protrusions 116*a*, 116*b* of the pair of clamp assemblies 112 coupled to the bottom beam 126 can then be adjusted so as to abut a front of the fence panel 108*d*, thereby further clamping it or restraining it against motion away from the rear panel 118.

In some cases, an additional retention element (not illustrated) can be coupled to the tread portion 106*d* of the fourth step 102*d*, such as to the rail coupled to the fourth step 102*d*. The additional retention element can engage a bottom-most portion of the fence panel 108*d* so as to prevent outward movement of the bottom-most portion of the fence panel 108*d* and thereby prevent the fence panel 108*d* from tilting backwards on the display system 100. In some cases, the additional retention element can be integrated into one or both of the clamp assemblies 112 coupled to the rail 110*d*. An additional fence panel (not shown in FIG. 1) can be secured to the display system 100 by first positioning the additional fence panel on the ground in front of the display system 100. In some cases, the additional fence panel can be centered in front of the display system 100. A pair of clamp assemblies 112 (not shown in FIG. 1) coupled to the rail 110*a* coupled to the first step 102*a* can then be adjusted so as to abut the additional fence panel, thereby clamping it or restraining it against motion in the direction of the width $W_1$ of the display system 100. For example, a left clamp assembly 112*a* coupled to the rail 110*a* can abut a first, left end (as viewed in FIG. 1) of the additional fence panel and a right clamp assembly 112*b* coupled to the rail 110*a* can abut a second, right end (as viewed in FIG. 1) of the additional fence panel. A pair of protrusions 116*a*, 116*b* of the pair of clamp assemblies 112 coupled to the rail 110*a* can then be adjusted so as to abut a front of the additional fence panel, thereby further clamping it or restraining it against motion away from the riser portion 104*a* of the first step 102*a*.

Thus, as described above, the display system 100 can be used to secure and display a number of fence panels equal to its number of steps plus one. The display system 100 can be provided with as few or as many steps as desired, and can be used to secure and display a corresponding number of fence panels. The display system 100 can be used to simultaneously display fence panels having different thicknesses and different lengths. Multiple display systems 100 can be positioned side-by-side to form a larger display system. In such embodiments, fence panels can be positioned such that they are supported by multiple display systems 100, e.g., such that they span across adjacent display systems 100. In some embodiments, a display system 100 can have a width $W_1$ such that multiple fence panels 108 can be supported on a single step 102. In such embodiments, four or more clamp assemblies 112 can be coupled to each rail 110.

The first, bottommost step 102*a* can include a pair of downward-facing grooves or recesses 128 formed at the bottom of the display system 100. In some cases, a forklift can be used to move the display system 100 and the grooves 128 can receive tines of the forklift to allow the forklift to more easily lift and move the display system 100 off of the ground. The grooves or recesses 128 may therefore define tine passageways or pockets for facilitating transport of the system 100 with or without the panels 108 secured thereto.

Figure 2A:
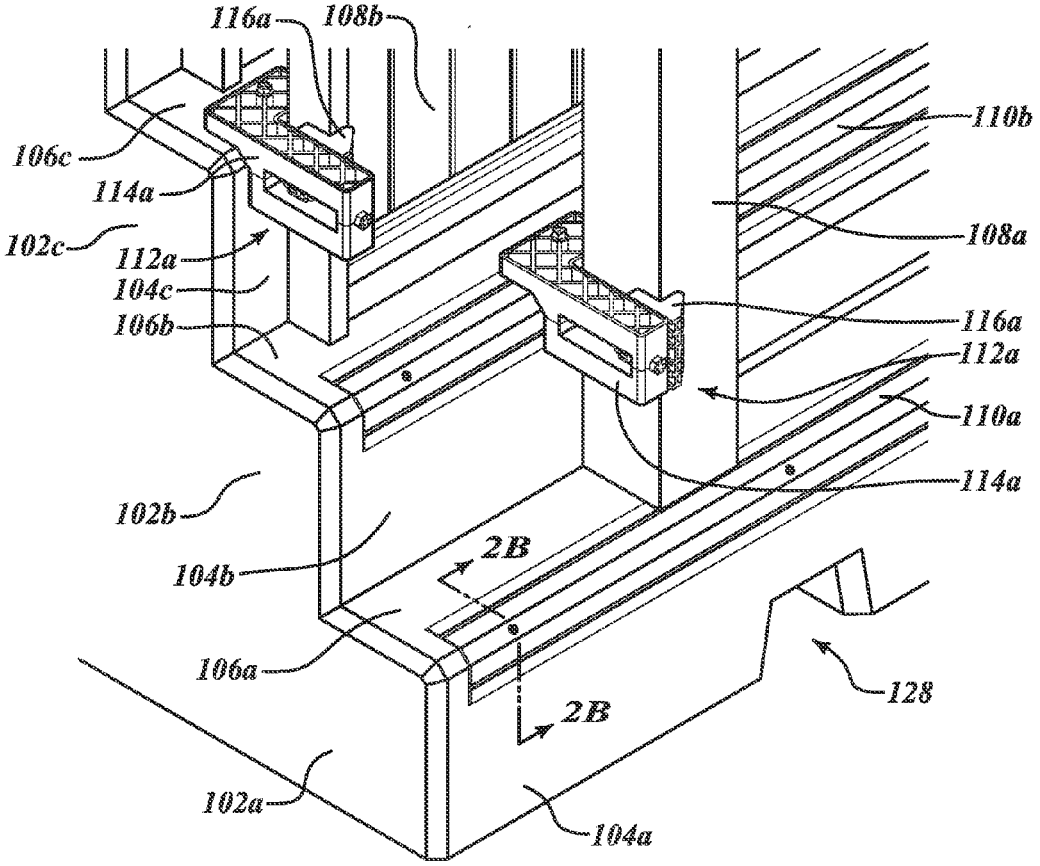
FIG. 2A illustrates an isometric view of a portion of the fence panel display system of FIG. 1 at a larger scale.
Figure 2B:
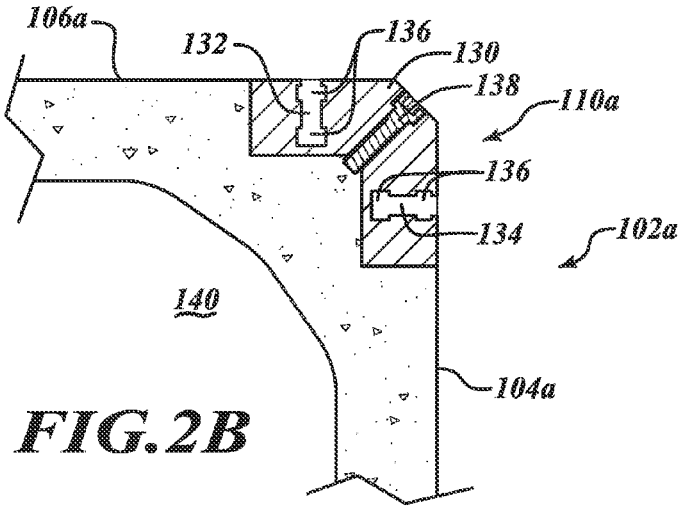
FIG. 2B illustrates a cross-sectional view of the fence panel display system of FIGS. 1 and 2A, taken across line 2B-2B shown in FIG. 2A.

FIGS. 2A and 2B illustrate portions of the display system 100 in greater detail. In particular, FIG. 2B illustrates a cross-sectional view of a portion of the first, bottommost step 102*a*. As shown in FIG. 2B, the rail 110*a* coupled to the first step 102*a* can include a main body 130, a first, vertical slot 132 in a top portion of the main body 130, and a second, horizontal slot 134 in a side portion of the main body 130. The vertical slot 132 and the horizontal slot 134 can each include one or more expanded areas 136 which can be wider than the rest of the respective slot 132, 134. The rail 110*a* can also include a pre-formed screw hole 138, such that a screw can be screwed through the hole 138 and into the first step 102*a* to couple the rail 110*a* to the step 102*a*. In some cases, the screw hole 138 and the screw can penetrate and extend all the way through the step 102*a* and the screw can engage with a corresponding nut on an underside of the step 102*a*. In some cases, such a nut can be embedded within the concrete of the step 102*a*.

The top portion of the rail 110*a* can be flush with the surface of the tread portion 106*a* of the step 102*a*, and the side portion of the rail 110*a* can be flush with the surface of the riser portion 104*a* of the step 102*a*. Because these surfaces are flush with one another, the clamp assemblies 112 and fence panels 108 can more easily slide across the surfaces of the display system 100. The step 102*a* can be hollow and have a cavity 140 rather than being solid, to reduce material costs and weight.

Figure 3:
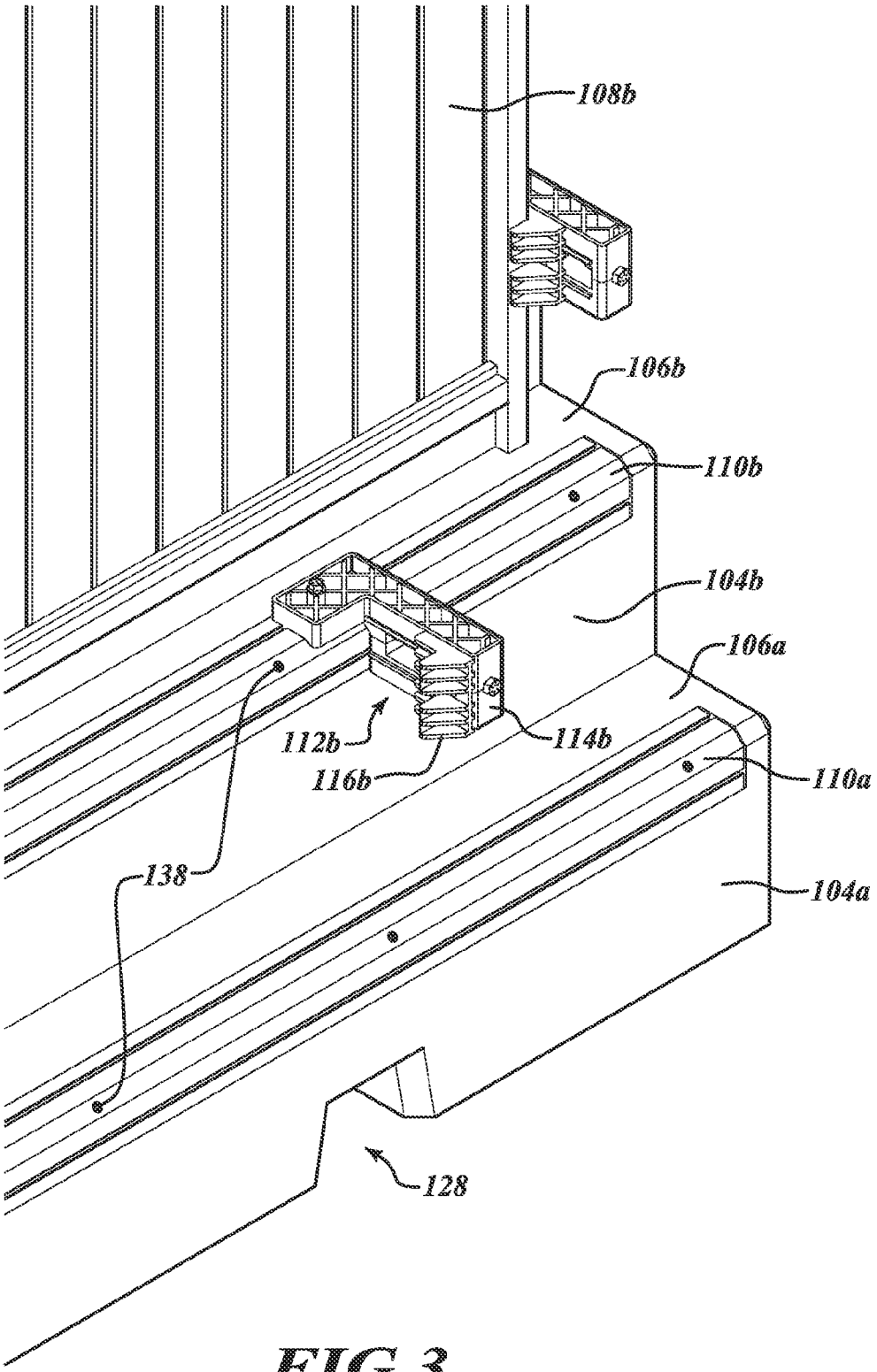
FIG. 3 illustrates an isometric view of a portion of the fence panel display system of FIG. 1 at a larger scale, with a bottommost one of the fence panels removed from the display system.
Figure 4:
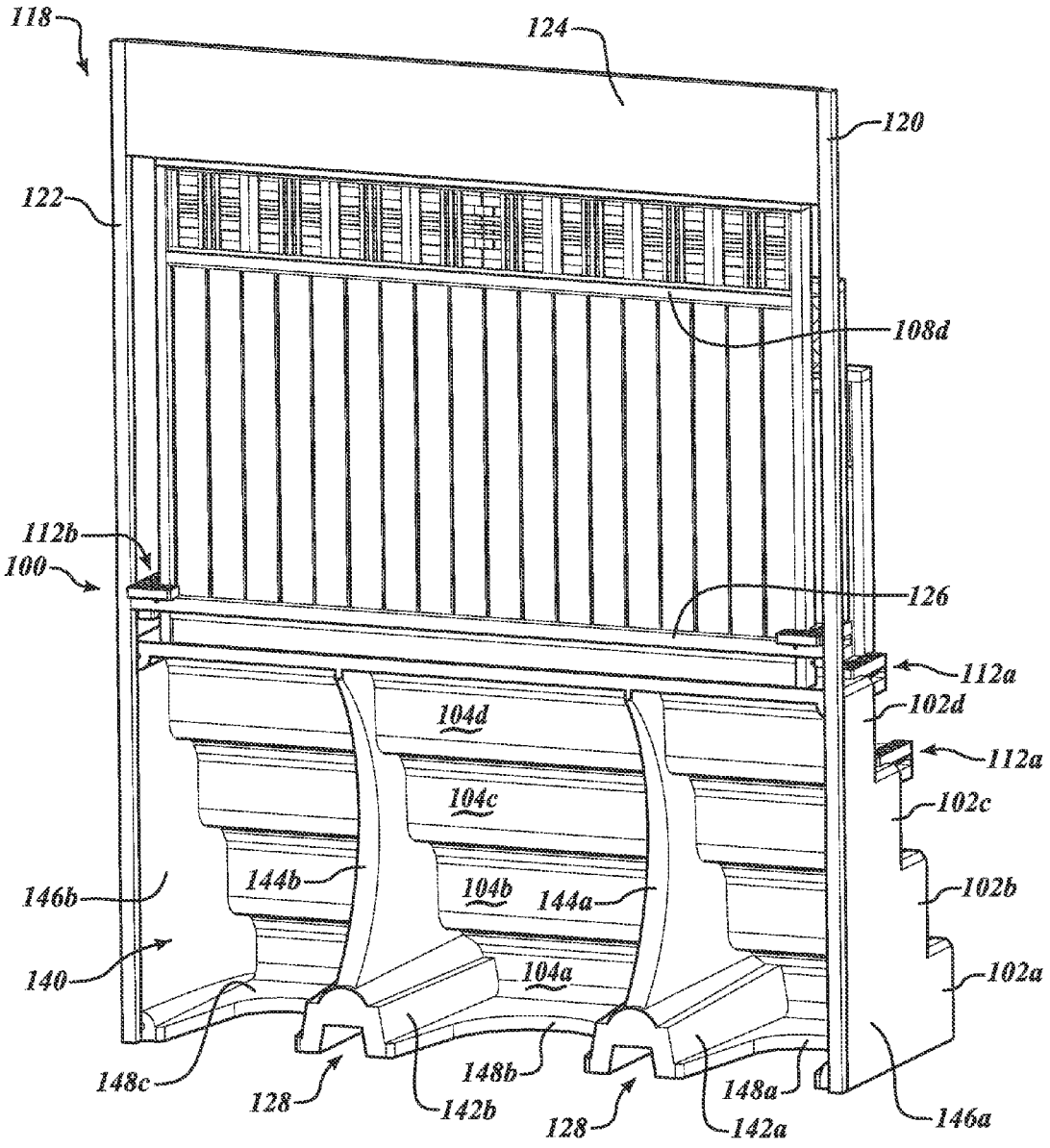
FIG. 4 illustrates a rear isometric view of the fence panel display system of FIG. 1.

FIG. 3 illustrates a portion of the display system 100, with the fence panel 108*a* removed, in greater detail. FIG. 4 illustrates the display system 100 from a rear view. As shown in FIG. 4, the steps 102 can be hollow and have the cavity 140 behind the riser portions 104 and beneath the tread portions 106 of the steps 102. The cavity 140 can be defined by the riser portions 104, the tread portions 106, the first and second sidewalls 146*a*, 146*b*, and the ground surface on which the display system 100 rests. Making the steps 102 hollow can reduce material costs required to fabricate the steps 102 and can reduce the weight of the steps 102 to ease transport.

The steps 102 can include a first channel 142*a* and a second channel 142*b* extending rearward from a rear surface of the riser portion 104*a* of the first, bottommost step 102*a*. The channels 142*a*, 142*b* can define the downward-facing grooves 128 formed at the bottom of the display system 100 for receiving tines of a forklift. The channels 142*a*, 142*b* can provide elongated surfaces extending from a front portion of the display system 100 to a rear portion of the display system 100 against which the tines of the forklift can bear when a forklift is used to move the display system 100.

To increase the structural rigidity and strength of the channels 142*a*, 142*b*, a first vertical buttress element 144*a* can extend vertically from the channel 142*a* and a second vertical buttress element 144*b* can extend vertically from the channel 142*b*. The buttress elements 144*a*, 144*b* can extend vertically from the channels 142*a*, 142*b* until they reach bottom surfaces of the tread portions 106 of the steps 102. When a forklift is used to lift the display system 100, the buttress elements carry compression and help to resist upward forces imparted by the tines of the forklift onto the underside of the channels 142*a*, 142*b*.

The steps 102 can also include partial floor elements 148*a*, 148*b*, 148*c* that further increase the strength of the steps 102 and the channels 142*a*, 142*b* by transferring loads between the various elements.

Figure 5A:
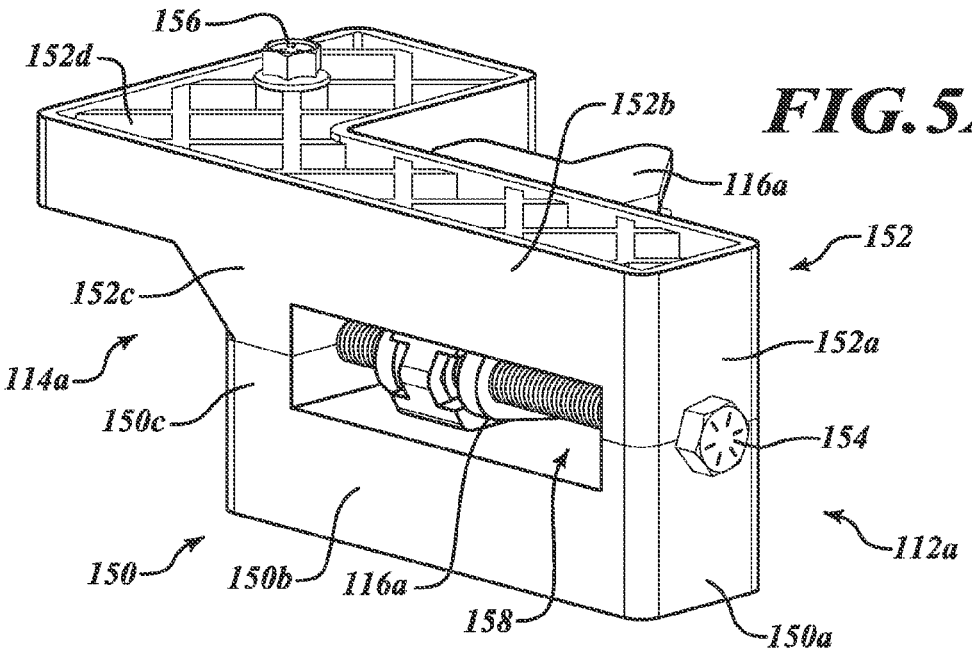
FIG. 5A illustrates a top-front isometric view of a clamp assembly component of the fence panel display system of FIG. 1.
Figure 5B:
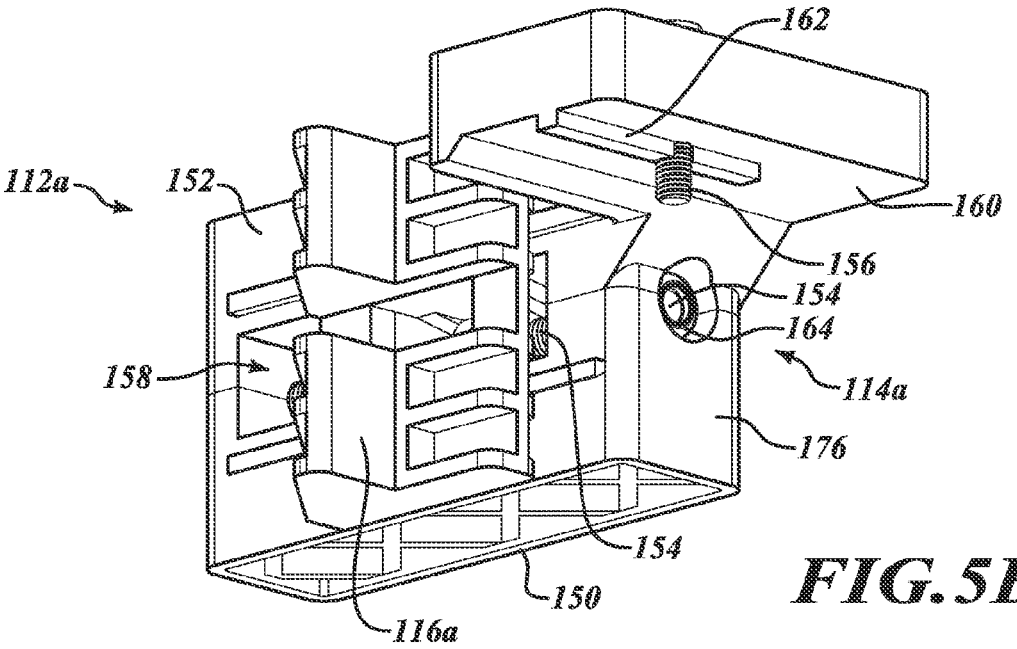
FIG. 5B illustrates a bottom-rear isometric view of the clamp assembly component FIG. 5A.
Figure 5C:
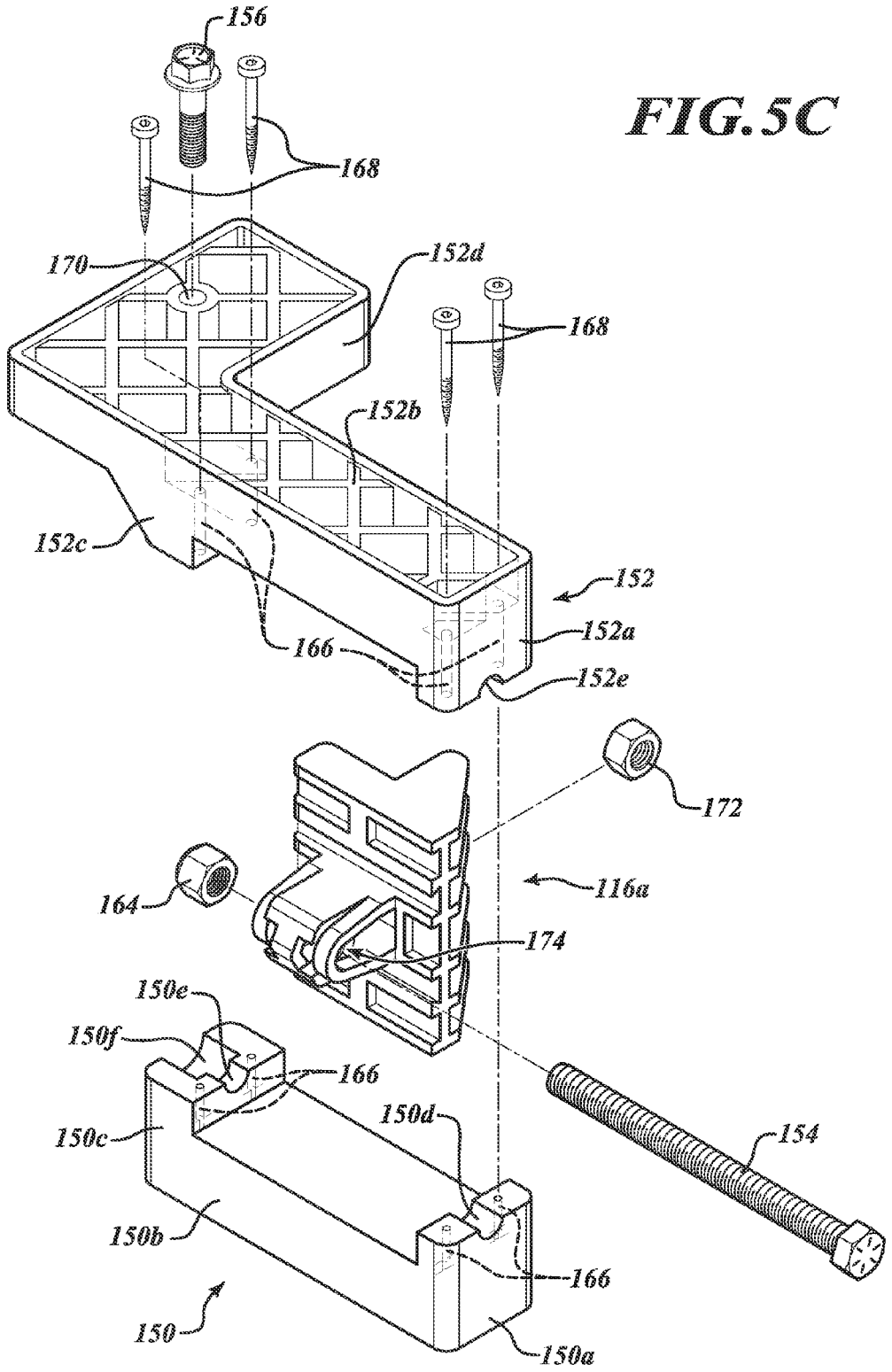
FIG. 5C illustrates an exploded view of the clamp assembly component of FIG. 5A.

FIGS. 5A-5C illustrate a left clamp assembly 112*a*, including its main body 114*a* and protrusion 116*a*, in greater detail. As noted above, a right clamp assembly 112*b* can have the same structure as, but be a mirror image of, a left clamp assembly 112*a*. As shown in FIG. 5A, the main body 114*a* can include a bottom half portion 150 and a top half portion 152. The bottom half portion 150 can include a horizontal portion 150B coupling a first vertical portion 150A to a second vertical portion 150C. The first and second vertical portions 150A, 150C can extend upward above a top of the horizontal portion 150B. The top half portion 152 can include a horizontal portion 152B coupling a first vertical portion 152A to a second vertical portion 152C. The first and second vertical portions 152A, 152C can extend downward below a bottom of the horizontal portion 152B. A laterally extending overhang portion 152D can be coupled to and extend laterally away from the vertical portion 152C.

A top of the vertical portion 150A can be coupled to a bottom of the vertical portion 152A and a top of the vertical portion 150C can be coupled to a bottom of the vertical portion 152C to couple the bottom half portion 150 to the top half portion 152 and leave an open void 158 between them. A horizontal bolt 154 can extend between the vertical portion 150A and the vertical portion 152A, through the open void 158, and between the vertical portion 150C and the vertical portion 152C. The protrusion 116*a* can be threadedly coupled to the horizontal bolt 154, such as within the open void 158. A vertical bolt 156 can extend through the overhang portion 152D.

FIG. 5B illustrates a bottom-rear view of the left clamp assembly 112*a*. As shown in FIG. 5B, the vertical bolt 156 can extend through the overhang portion 152D and out beyond a bottom surface 160 of the overhang portion 152D. The bottom surface 160 can also include a longitudinal ridge 162 protruding therefrom and extending in the same direction as the protrusion 116*a* extends from the main body 114*a* (i.e., in the direction of the width $W_1$ of the display system 100 when the left clamp assembly 112*a* is coupled to a rail 110 of the display system 100).

FIG. 5C illustrates an exploded view of the left clamp assembly 112*a*. As shown in FIG. 5C, the bottom half portion 150 includes a first semi-circular recess 150D in the first vertical portion 150A for receiving half of a profile of the horizontal bolt 154, a second semi-circular recess 150E in the second vertical portion 150C for receiving half of a profile of the horizontal bolt 154, and a third semi-circular recess 150F in the second vertical portion 150C for receiving half of a nut 164 to be threaded onto the end of the horizontal bolt 154. The nut 164 can be a self-locking nut including a nylon collar insert having an inside diameter smaller than a major diameter of the horizontal bolt 154. Similarly, the top half portion 152 includes a first semi-circular recess 152E in the first vertical portion 152A for receiving half of a profile of the horizontal bolt 154, a second semi-circular recess (not shown) in the second vertical portion 152C for receiving half of a profile of the horizontal bolt 154, and a third semi-circular recess (not shown) in the second vertical portion 150C for receiving half of the nut 164 to be threaded onto the end of the horizontal bolt 154.

The recesses (e.g., 150D, 150E, 152E) can be un-threaded such that the horizontal bolt 154 can be freely rotatable with respect to the main body 114*a* of the left clamp assembly 112*a*. The top half portion also includes a through-hole 170 for receiving the vertical bolt 156. The top half portion 152 and the bottom half portion 150 each include four vertical holes 166 for receiving coupling screws 168. Alternatively, or in addition, the top half portion 152 and the bottom half portion 150 can be welded ultrasonically to one another. The protrusion 116*a* includes a coupling portion 174 having a nut 172 fixedly secured therein.

To assemble the left clamp assembly 112*a*, the nut 172 can be installed within the coupling portion 174 of the protrusion 116*a*. The horizontal bolt 154 can be threaded through the nut 172 and then the nut 164 can be threaded onto the end of the horizontal bolt 154. The horizontal bolt 154 can then be seated within the recesses 150D, 150E such that the nut 164 is also seated within the recess 150F and such that the coupling portion 174 will be positioned within the open void 158 of the assembled left clamp assembly 112*a*. The top half portion 152 can then be seated on top of the bottom half portion 150, and the screws 168 can be threaded through the holes 166 to secure the top half portion 152 to the bottom half portion 150. The vertical bolt 156 can be inserted through the hole 170.

To install the left clamp assembly 112*a* onto a rail such as rail 110*a*, the ridge 162 and the bottom end portion of the vertical bolt 156 can be seated within the vertical slot 132 of the rail 110*a*. In some cases, the horizontal bolt 154 can extend through the vertical portions 150C, 152C, and out beyond a side surface 176 (FIG. 5B) of the left clamp assembly 112*a*. In such cases, a terminal end portion of the horizontal bolt 154 can be seated within the horizontal slot 134 of the rail 110*a*. In some cases, a nut can be positioned within one or more of the expanded areas 136 of the rail 110*a*. In such cases, the vertical bolt 156 and/or the horizontal bolt 154 can be threaded into the nuts in the expanded areas 136 to further secure the respective bolt to the rail 110*a*.

Such nuts can be installed within the expanded areas 136 in various ways. In one example, the vertical slot 132 or the horizontal slot 134 can include an enlarged machined hole sized to allow a nut to be inserted therein and coupled to the expanded areas 136. Thus, a nut can be inserted through the enlarged machined hole into the expanded areas 136, where it can then slide back and forth along the length of the rail 110 through the expanded area 136. In some cases, the enlarged machined hole can be positioned at a least used location of the rail 110, such as near the edges or at the center of the rail 110. Nuts can be installed, removed, or replaced in this manner. In another example, a rail 110 can be removed from the foundation such that one or more nuts can be installed within, removed from, or replaced in the expanded areas 136 at the terminal ends of the rail 110.

When the vertical bolt 156 is seated within the vertical slot 132 and/or the horizontal bolt 154 is seated within the horizontal slot 134, the left clamp assembly 112*a* can slide horizontally along the rail 110*a* in the direction of the width $W_1$ of the steps 102. Thus, the left clamp assembly 112*a* is adjustable with respect to the steps 102 in a first direction. As explained above, the nut 172 is fixedly coupled to the protrusion 116*a* and threaded onto the horizontal bolt 154. Because the protrusion 116*a* cannot rotate about the horizontal bolt 154, however, for example, because it would collide with the bottom half portion 150 or the top half portion 152, rotation of the horizontal bolt 154 induces horizontal movement of the protrusion 116*a* with respect to the main body 114*a*. Thus, when the vertical bolt 156 is seated within the vertical slot 132 and/or the horizontal bolt 154 is seated within the horizontal slot 134, and when the horizontal bolt 154 is rotated with respect to the main body 114*a*, the protrusion 116*a* slides horizontally with respect to the main body 114*a* in a direction perpendicular to the width $W_1$ of the steps 102. Thus, the left clamp assembly 112*a* is adjustable with respect to the steps 102 in a second direction.

The various components of the display system 100 can be fabricated from various materials. In some cases, fabricating the steps 102 from concrete, the rails 110 from metal such as steel or aluminum (e.g., by extrusion), the clamp assemblies 112 from plastic (e.g., by injection molding), and the rear panel 118 from wood can be particularly advantageous. In different embodiments, however, various materials can be used for each of the components.

In some methods of fabricating the display system 100, the steps 102, including the riser portions 104 and the tread portions 106, the sidewalls 146*a*, 146*b*, the channels 142*a*, 142*b*, the buttress elements 144*a*, 144*b*, and the partial floor elements 148*a*, 148*b*, 148*c* can all be fabricated as a single formation of concrete or other material, such as, for example, from a single batch of concrete or other material deposited in a formwork or mold. Such a single piece of concrete or other material can be referred to as a "foundation" of the display system 100. In some cases, the foundation can be formed from high-strength concrete, and/or from a glass fiber reinforced concrete. A thickness of the various components of the foundation can be balanced with the strength of the concrete used to obtain a foundation having a desired overall strength.

In some cases, an interior surface of the formwork within which the foundation may be cast can be coated with a GFRC spray mix, so as to create a relatively thin, high-strength outer shell of the foundation. In some cases, internal reinforcements, such as metal studs, can also be installed within the formwork. After the formwork has been coated and the reinforcements have been installed, a self-consolidating concrete (SCC) mix can be cast within the formwork and the thin, high-strength outer shell. This can provide for a particularly thin walled and light foundation for the display system 100.

A method of fabricating and assembling the display system 100 can include casting a plurality of steps, as described above. The method can also include fabricating at least one rail and fabricating the components of and assembling at least two clamp assemblies, as described above. The method can also include coupling the rail to a step such that the rail extends along a width of the step, and coupling the clamp assemblies to the rail, as described above. The method can further include securing or clamping a fence panel to the display system, as described above.

The steps 102 and the foundation described above can be used in some embodiments to display items other than fence panels. For example, the steps 102 and the foundation described above can be used to display potted plants. For example, the foundation can include one or more holes or openings through which pipes or hoses can be passed to irrigate the potted plants. Further, a locking assembly can encase the foundation and the potted plants displayed thereon, such as to prevent theft or vandalism of the potted plants.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, including U.S. provisional patent application No. 62/037,547, filed Aug. 14, 2014 and titled "Fence Panel Display Systems and Methods," are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A product display system, comprising:

a foundation having a plurality of steps formed of a unitary body of material, each step having a step width, a riser portion, and a tread portion;

a rail having a vertical portion and a horizontal portion, the vertical portion coupled to an upper edge of the riser portion of one of the plurality of steps, and the horizontal portion coupled to an outer edge of the tread portion of the one of the plurality of steps, the rail extending along a direction of the step width;

a first clamp element coupled to the rail and adjustable on the rail along the direction of the step width; and a second clamp element coupled to the rail and adjustable on the rail along the direction of the step width.

2. The system of claim 1 wherein:

the first clamp element includes a first main body extending horizontally outward from the rail and a first protrusion extending outward from the first main body toward the second clamp element; and the second clamp element includes a second main body extending horizontally outward from the rail and a second protrusion extending outward from the second main body toward the first clamp element.

3. The system of claim 1 wherein the first clamp element and the second clamp element are configured to slide along the rail to clamp a fence panel between the first clamp element and the second clamp element.

4. The system of claim 1, further comprising:

a fence panel clamped between the first clamp element and the second clamp element.

5. The system of claim 4 wherein the foundation includes at least a first step and a second step above the first step and the fence panel is supported on the second step.

6. The system of claim 1 wherein the foundation further comprises a pair of recesses sized and shaped to receive tines of a forklift.

7. The system of claim 1, further comprising:

a second rail coupled to another one of the plurality of steps and extending along the direction of the step width;

a third clamp element coupled to the second tail and adjustable on the second rail along the direction of the step width; and a fourth clamp element coupled to the second rail and adjustable on the second rail along the direction of the step width.

8. The system of claim 7 wherein the foundation is formed of a unitary body of concrete.

9. The system of claim 8 wherein the foundation has a cavity underneath each of the plurality of steps.

10. The system of claim 1 wherein the unitary body of material is made of glass-fiber reinforced concrete.

11. The system of claim 1 wherein a top portion of the rail is flush with the tread portion of the one of the plurality of steps and a side portion the rail is flush with the riser portion of the one of the plurality of steps.

* * * * *